US005919333A

United States Patent [19]

Maltby et al.

[11] Patent Number: 5,919,333

[45] Date of Patent: Jul. 6, 1999

[54] BRAKED LINEAR NIPPER

[75] Inventors: John D. Maltby; Robert K. Fogg, Jr., both of San Diego, Calif.

[73] Assignee: The United States of America as represented by the Secretary of the Navy, Washington, D.C.

[21] Appl. No.: 08/974,142

[22] Filed: Nov. 19, 1997

Related U.S. Application Data

[63] Continuation of application No. 08/563,714, Nov. 28, 1995, abandoned.

[51] Int. Cl.[6] ..... B65H 23/00

[52] U.S. Cl. ..... 156/425; 156/583.5; 242/419.5; 242/419.9

[58] Field of Search ..... 156/425, 428, 156/430, 431, 195, 583.5; 242/419, 419.4, 419.5, 419.8, 419.9; 226/38, 39

[56] References Cited

U.S. PATENT DOCUMENTS

| | | | |
|---|---|---|---|
| 795,581 | 7/1905 | Corby et al. . | |
| 836,776 | 11/1906 | Oliver . | |
| 1,224,993 | 5/1917 | Anderson . | |
| 1,989,048 | 1/1935 | Winter et al. . | |
| 2,048,754 | 7/1936 | Putnam | 242/419.9 X |
| 2,881,715 | 4/1959 | Heim . | |
| 3,276,705 | 10/1966 | Erickson et al. | 242/419.9 |
| 3,417,168 | 12/1968 | Keith . | |
| 3,547,742 | 12/1970 | Cottrell . | |
| 3,580,795 | 5/1971 | Eichenlaub | 156/583.5 X |
| 3,735,937 | 5/1973 | Plantard | 242/419.9 X |
| 3,870,249 | 3/1975 | Schrader et al. | 242/419.9 X |
| 4,375,350 | 3/1983 | Sato . | |
| 4,571,220 | 2/1986 | Nakano et al. . | |
| 4,647,417 | 3/1987 | Bottger et al. . | |
| 4,850,848 | 7/1989 | Greten et al. . | |
| 5,112,209 | 5/1992 | Ahrweiler et al. . | |
| 5,265,817 | 11/1993 | Gaudin | 242/419.9 X |
| 5,421,534 | 6/1995 | Arnold et al. | 242/419.5 |

*Primary Examiner*—James Engel

*Attorney, Agent, or Firm*—Harvey Fendelman; Michael A. Kagan; Eric James Whitesell

[57] ABSTRACT

The braked linear nipper of the present invention comprises a belt roller, a belt, and a belt load for applying a squeeze load along a length of a linear material being pulled along the belt by an object onto which the linear material is being wound. The linear material imparts motion to the belt via friction coupled by the squeeze load. A brake coupled to the belt induces a tension in the linear material.

15 Claims, 8 Drawing Sheets

BRAKED LINEAR NIPPER

This is a continuation of application Ser. No 08/563,714 filed Nov. 28, 1995.

BACKGROUND OF THE INVENTION

The present invention relates to filament winding and tape wrapping devices. More specifically, but without limitation thereto, the present invention relates to an apparatus for imparting high tensile load to a continuous-feed linear material without damaging the material.

Filament winding of composite structures has been practiced for over 30 years. Typically, dry fibrous tows of collimated fibers (e.g., glass, carbon, etc.) are pulled from one or more spools and impregnated with a resin by passing them through a resin bath. One or more impregnated tows are wound around a mandrel at various wind angles and cured.

There are variations to this process; for example, the fiber tows may be impregnated with resin and partially cured into a laterally stiff tape before being loaded onto the filament winding machine. This allows better control of the resin impregnation process, resulting in higher quality filament wound structures. The impregnated tows may initially be consolidated into tapes as wide as 60 inches, which are subsequently slit and spooled to narrower widths for loading onto a tape wrapping (i.e., filament winding) machine.

Two examples of composite structures that are fabricated by winding impregnated tows (or partially cured tapes) around a rotating hollow mandrel are pressure vessels and drive shafts. The tape wrapping of structural columns for bridges is an example in which the wrapped structure remains stationary while the winding machine rotates around the column.

Maintaining accurate control of the tension in the filament winding process is important to obtain consistent structural performance in the finished part. The magnitude of winding tension is also important. Winding the composite tape under relatively high winding tension can help reduce entrapped air in the finished part, resulting in a higher quality product. Although residual stresses resulting from high winding tension can be detrimental to structural integrity, they can also be of tremendous structural benefit if they are properly managed.

Current winding practice imparts winding tensile stresses that are only a fraction of the strength of the wound composite material. The tensile strength of a partially cured composite tape can easily exceed 60,000 pounds per square inch (psi), and yet the winding tension is typically much less than 10,000 psi. Clearly, from the standpoint of material strength, there exists the potential to develop significantly higher wound-in residual stresses by winding the materials under much higher tension loads.

The primary reason that composite materials are not wound under very high tension may be that the advantages of high tension loads have not yet been recognized or properly understood. Therefore, special material handling hardware for winding under extremely high tension has not yet been developed.

Examples of relatively recent structural applications of composites that may benefit from high winding tension are composite-wrapped structural columns and thick-walled composite flywheels.

Special design considerations are required for developing extremely high winding tension in the winding hardware, both in the mandrels and in the power winding machinery, and particularly in the material payout apparatus and tensioning devices. The payout and tensioning devices must be strong and rigid enough to withstand the higher loads without damaging fragile composite materials that are particularly susceptible to damage from tight bending radii and pinch loads during handling. Preventing such damage becomes a critical concern when handling these materials under high tension loads.

A common method in the prior art for developing filament winding (or tape wrapping) tension is to reel the filament or tape material from a braked spool. The tension that may be developed from a braked spool is limited by the tension at which the tape was wound onto the spool. To impart high tension with a braked spool, the tape must first be wound on the spool at the desired dispensing tension, which may exceed the crush strength of the inner spool core. Even with a stronger core, underlying spooled material may become distorted and damaged by overlying material when extremely high tension is applied. Therefore a braked spool is inadequate for dispensing materials under extremely high tension loads.

Another way to impart tension to a linear continuous material is to pull the material through a series of braked rollers arranged in a serpentine configuration. FIG. 1 illustrates an example of a multiple roller, frictionally braked tensioner 10 of the prior art. A series of rollers 102 are typically linked together by a common chain drive (not shown), with at least one roller being frictionally braked. A continuous linear material 104 is pulled along rollers 102 by a takeup load P. A problem with this device is that for high values of takeup load P, several rollers are required to develop the friction that prevents continuous linear material 104 from slipping, thus increasing the size of the device.

Still another way to impart tension to a linear continuous material is to pull the material through braked nip rollers 20 in FIG. 2. This device requires sufficient friction between continuous linear material 104 and opposing nip rollers 202 to impart the required braking force to continuous linear material 104. The magnitude of the friction developed is proportional to the compressive squeeze load of nip rollers 202 against continuous linear material 104. The squeeze load is distributed lightest where nip rollers 202 first contact continuous linear material 104 and increases to a maximum where nip rollers 202 are closest together. This concentration of squeeze load at a small section of linear material 104 is called point load. The maximum tension that may be applied to linear material 104 depends on the frictional grip of nip rollers 202 holding linear material 104. The frictional grip of nip rollers 202 depends partly on the squeeze load. If the squeeze load exceeds the crush strength of continuous linear material 104, point load damage occurs.

A need therefore exists in filament and tape winding applications for a compact device to dispense continuous linear materials under high tension without damaging the materials.

SUMMARY OF THE INVENTION

The braked linear nipper of the present invention is directed to overcoming the problems described above, and may provide further related advantages. No embodiment of the present invention described herein should be construed to preclude other embodiments or advantages that may exist or become obvious to those skilled in the art.

The braked linear nipper of the present invention comprises a belt roller, a belt, and a belt load for applying a squeeze load along a length of a linear material being pulled along the belt by an object onto which the linear material is being wound. The linear material imparts motion to the belt via friction coupled by the squeeze load. A brake coupled to the belt induces a tension in the linear material.

An advantage of the braked linear nipper is that composite fiber tows and tape materials may be wound under extremely high tension without damage during winding.

Another advantage is that the compact size afforded by the design of the braked linear nipper facilitates incorporating the braked linear nipper in a traversing dispenser mechanism.

The features and advantages summarized above in addition to other aspects of the present invention will become more apparent from the description, presented in conjunction with the following drawings.

DESCRIPTION OF THE INVENTION

The following description is presented solely as an example of how the present invention may be made and used. The scope of the invention is defined by the claims.

Figure 1:
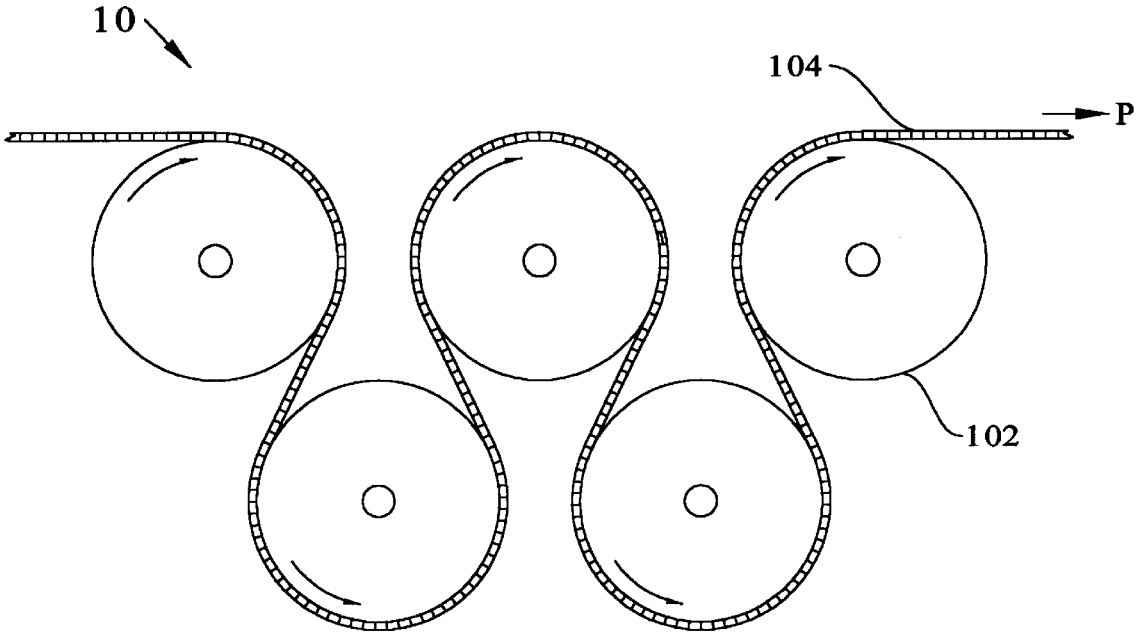
PRIOR ART FIG. 1
FIG. 1 is a side view of a multiple roller, frictionally braked tensioner of the prior art.
Figure 2:
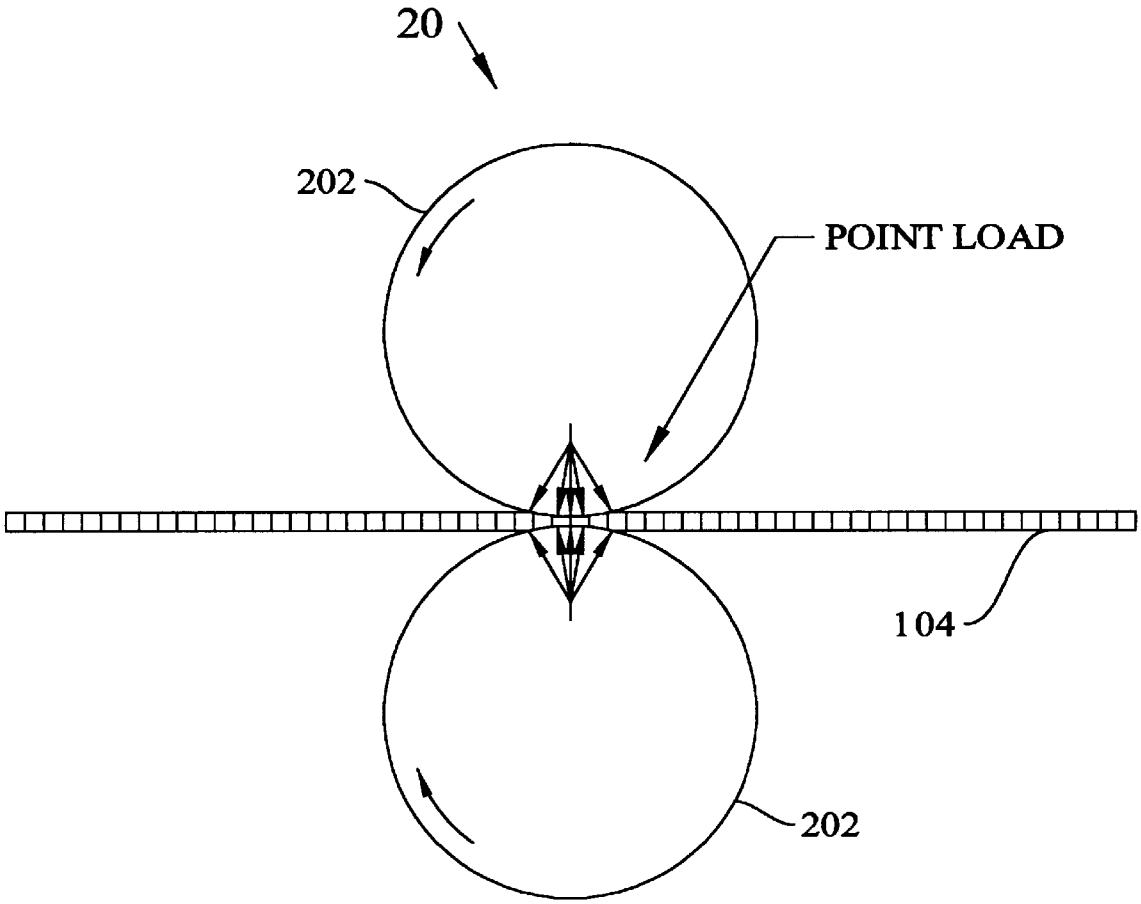
PRIOR ART FIG. 2
FIG. 2 is a side view of a nip roller of the prior art.
Figure 3:
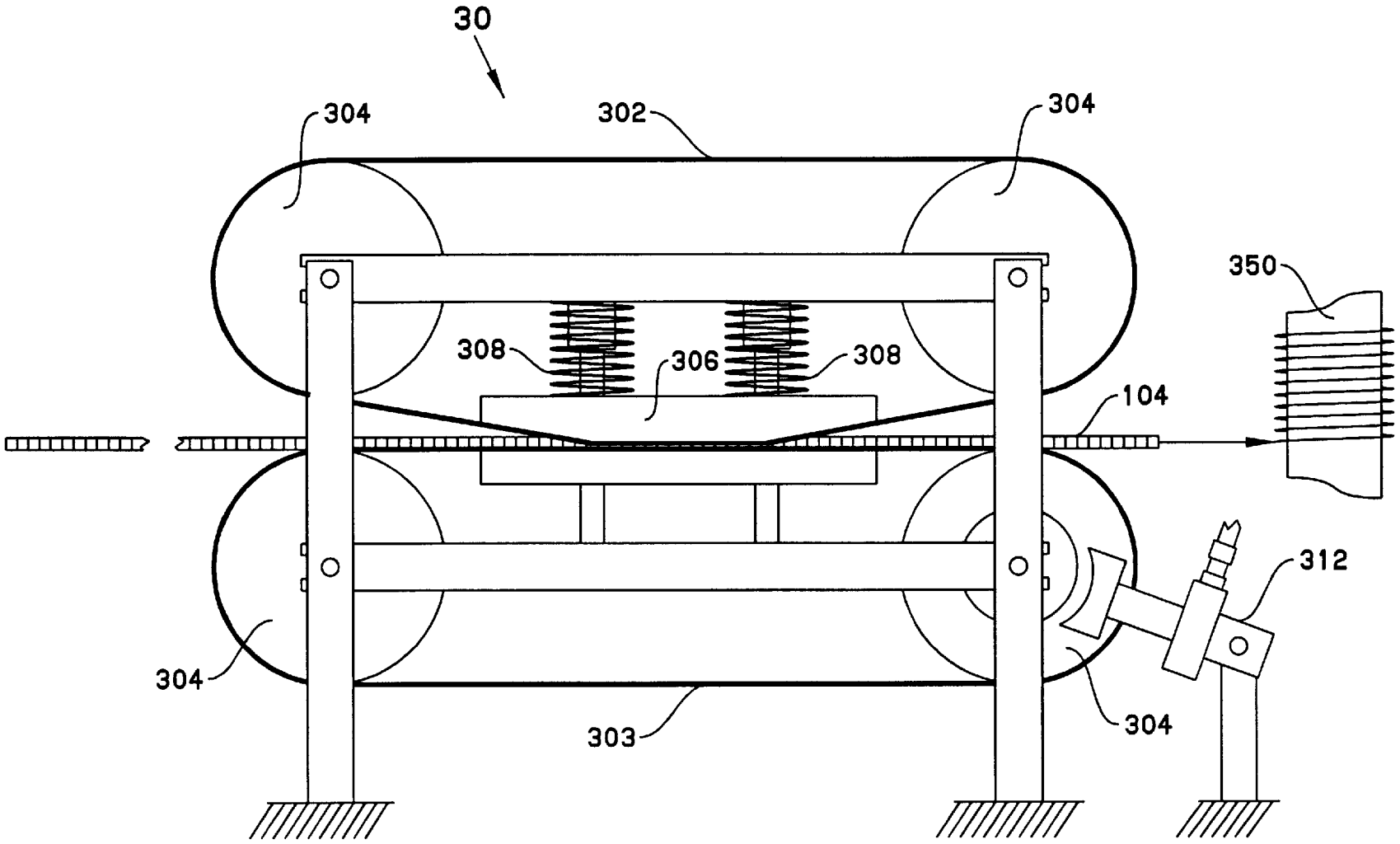
FIG. 3 is a side view of a braked linear nipper of the present invention with a linear belt load imparted by squeeze load platens.

FIG. 3 is a side view of a braked linear nipper 30 of the present invention. Belt 302 imparts a squeeze load to linear material 104 from squeeze load platen 306 under a compression belt load from springs 308. In this arrangement, opposing belt 303 is braked by a frictional brake 312 to subject linear material 104 to a tension as it is being wound, for example, onto a rotating object such as a cylinder 350. Brake 312 may also be an electromagnetic or another type of brake mechanism for applying counter-torque to one or more of rollers 304. Cylinder 350 may be, for example, a winding mandrel or a drive shaft that pulls linear material 104 from braked linear nipper 30.

In contrast to a conventional double belt press such as described by Cottrell in U.S. Pat. No. 3,547,742, included herein by reference thereto, braked linear nipper 30 functions to induce extremely high tension in linear material 104 being pulled through it. The pulled linear material 104 imparts motion to belt 302 and opposing belt 303 from frictional coupling via the squeeze load. This motion is resisted by brake 312, causing tension in linear material 104. In contrast, the double belt press functions to move and press a linear material and does not at all address the problem of extremely high tensioning solved by braked linear nipper 30.

Figure 4:
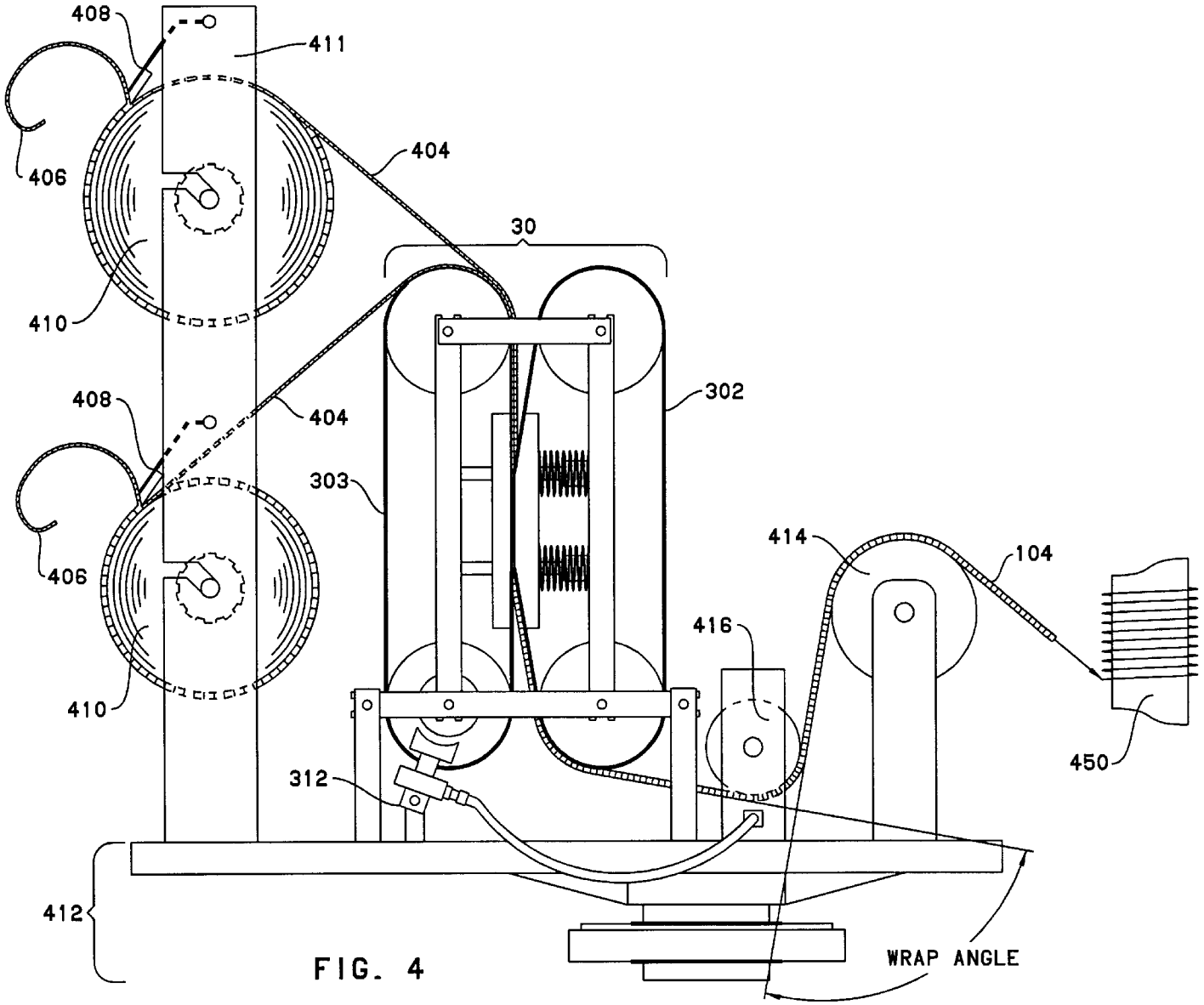
FIG. 4 is a side view of an example of a traversing winder of the present invention.

FIG. 4 is a side view of a traversing winder 40 incorporating the braked linear nipper of FIG. 3 mounted on a frame 412 that travels around a stationary object, such as a structural column 450. Braked linear nipper 30 has belts 302 and 303 that may be made, for example, from a thin metal such as spring steel. The outside of belts 302 may be coated with a material such as polyurethane to increase the friction of roller belts 302 against linear material 104. In this embodiment of the present invention, linear material 104 comprises two rolls of composite tape 404 having a standard 3-inch width and a 10-inch outside diameter dispensed from a tape dispenser 411. Generally, rolls of composite tape 404 are available from established vendors such as 3M or Hercules. Braked linear nipper 30 typically accommodates composite tapes having a width less than the width of roller belts 302.

A backing paper 406 is commonly laminated to one side of composite tapes 404 to prevent self-adhering. Weighted blades 408 may be used to peel backing paper 406 from composite tapes 404 as composite tapes 404 are being pulled through linear nipper 30. Multiple tapes may be dispensed simultaneously from tape dispenser 411, allowing composite tapes 404 to be laminated during the winding operation. Tape creels 410 may be mounted on traversing frame 412 with braked linear nipper 30 to allow tape winder 40 to follow the surface on which composite tapes 404 are being wound, in this case structural column 450. Traversing frame 412 may be mounted on a standard filament winding machine, a linear slide, or a curved track for winding tape around stationary objects supplying the takeup load such as structural column 450.

A payout roller 414 may be used to maintain a constant wrap angle on sensor control 416. Sensor control 416 senses the braking tension induced in linear material 104 and varies the pressure applied by brake 312 accordingly to maintain a constant braking tension in linear material 104 as linear material 104 is being wound on structural column 450.

Figure 5:
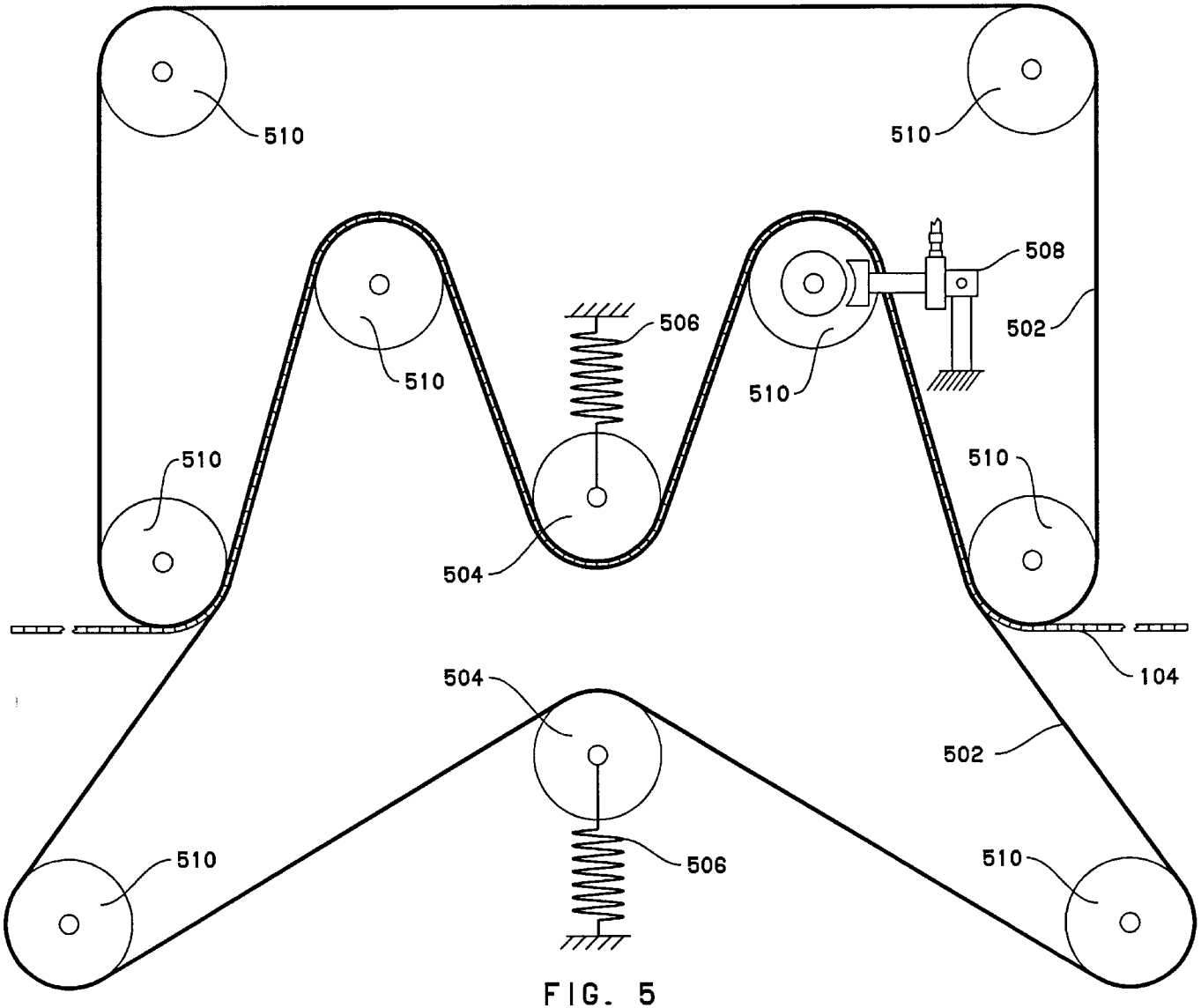
FIG. 5 is a side view of a braked linear nipper of the present invention with multiple belt rollers and two belts.

FIG. 5 is a side view of a braked linear nipper 50 having two belts and multiple rollers. In this arrangement, a belt load is applied to belts 502 guided on belt rollers 510 by tension rollers 504 and springs 506, and braking tension is imparted by brake 508 against one of belt rollers 510.

Figure 6:
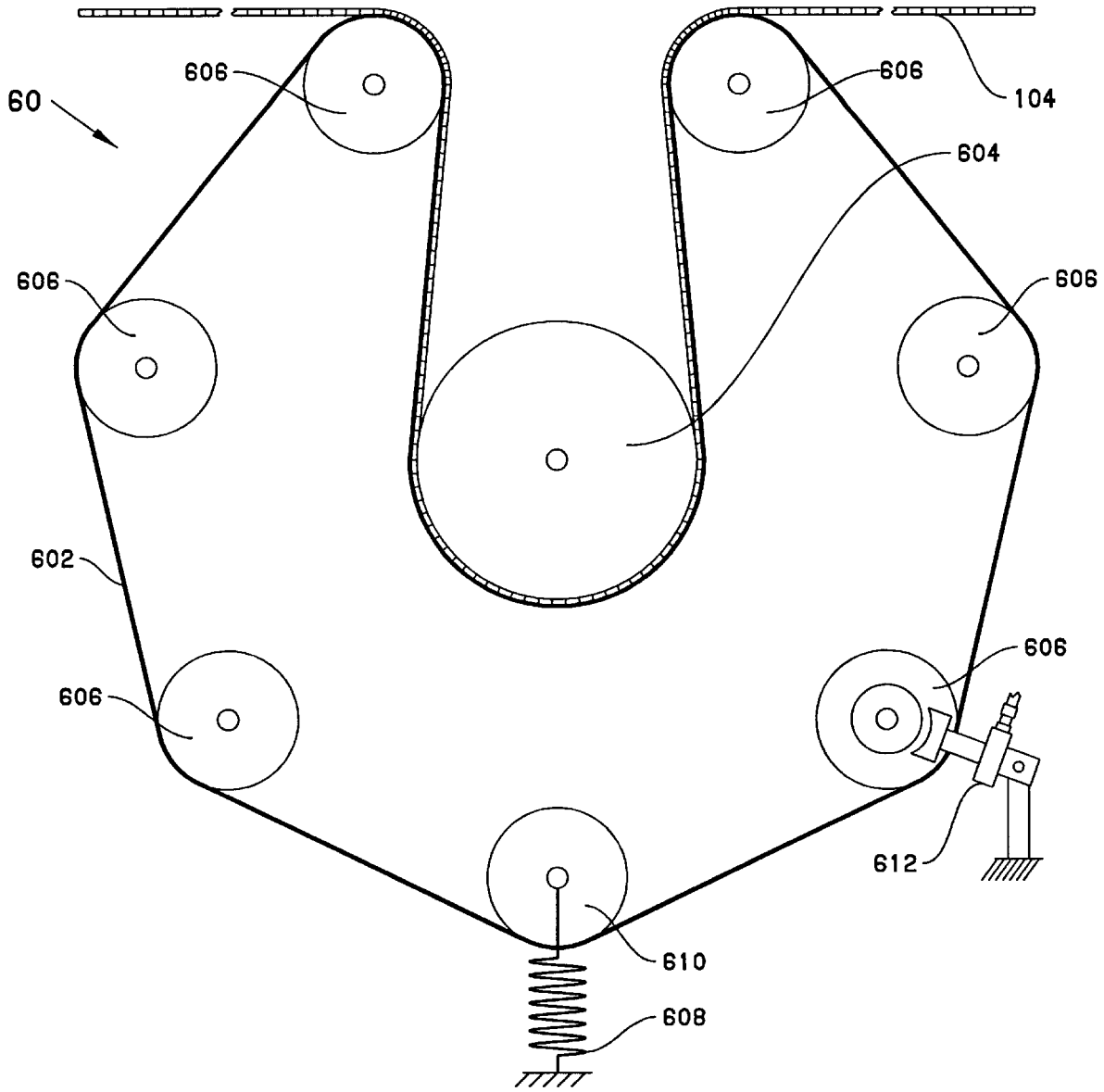
FIG. 6 is a side view of a braked linear nipper of the present invention with one belt, a pulley, and multiple belt rollers.

FIG. 6 is a side view of a braked linear nipper 60 having one belt, a pulley, and multiple rollers. In this arrangement, belt 602 is wrapped around pulley 604. Linear material 104 is pulled from between belt 602 and pulley 604. A belt load is applied to belt 602 by tension roller 610 and spring 608. The belt load induces tension in belt 602, urging it against pulley 604 to apply a squeeze load to linear material 104. Braking force is imparted by brake 612 against one of belt rollers 606, imparting tension to linear material 104.

Another arrangement well suited for implementing a braked linear nipper of the present invention is the wrapping transmission of Nakano et al., U.S. Pat. No. 4,571,220, included herein by reference thereto. However, instead of driving a pulley, belts 1 and 44 are used to impart a squeeze load to a linear material pulled between them by the object onto which the linear material is being wound. The pulled linear material imparts motion to the belts, and one of the pair of pulleys is braked to impart a braking tension to the linear material.

Figure 7:
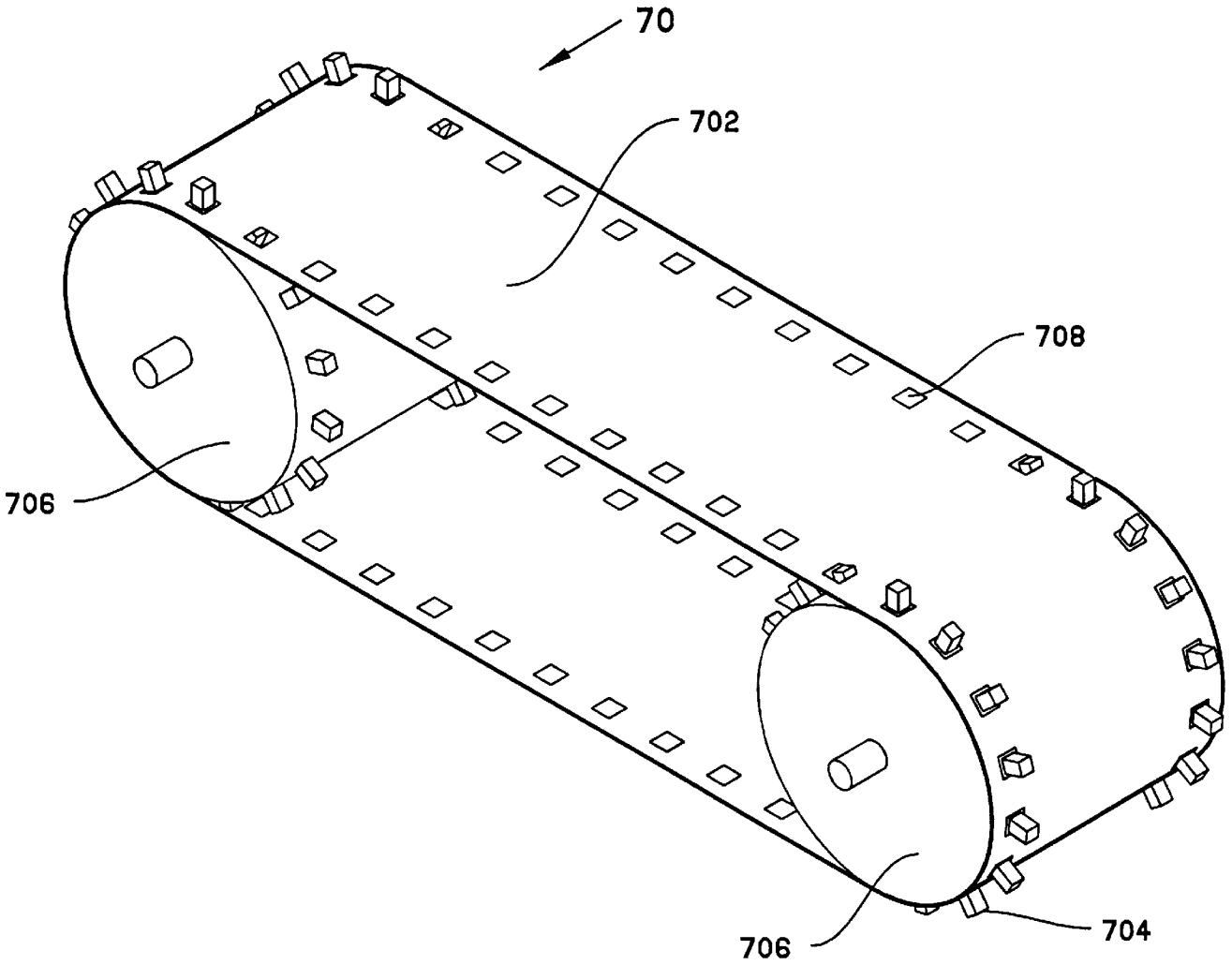
FIG. 7 is a perspective view of a pin roller and belt assembly.

FIG. 7 is a perspective view of a pin roller belt assembly 70 that may be used to practice the present invention. Belt 702 is engaged by roller pins 704 on at least one of rollers 706 through belt holes 708. In this arrangement, positive traction is used to couple roller belt 702 to pin rollers 706 instead of frictional coupling. This prevents roller belt 702 from slipping on rollers 706, allowing a greater magnitude of braking tension to be developed.

Figure 8:
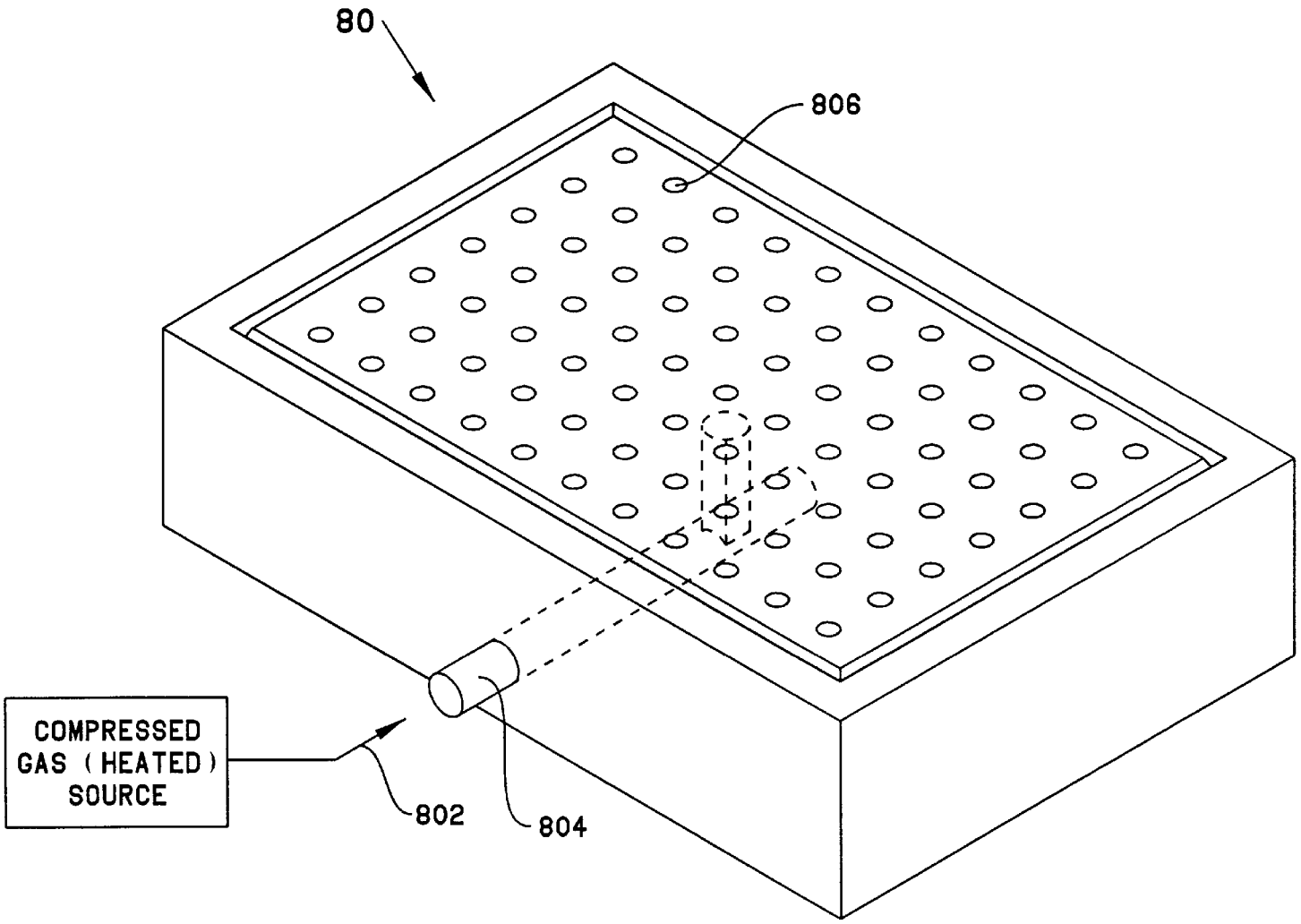
FIG. 8 is a perspective view of a squeeze load platen of the present invention using compressed gas as a lubricant.

FIG. 8 is a perspective view of a squeeze load platen 80 of the present invention. A compressed gas 802 is introduced into an inlet 804 and exits from ports 806. Ports 806 may be a pattern of holes or channels for distributing compressed gas 802 to form a layer of compressed gas between squeeze load platen 80 and belt 302 in FIG. 3. The pressure of compressed gas 802 is selected to impart the desired squeeze load while maintaining a spacing between squeeze load platen 80 and belt 302 in FIG. 3 to reduce friction. Compressed gas 802 may also be heated to control the temperature of belt 302 for laminating purposes.

Other modifications, variations, and applications of the present invention may be made in accordance with the above teachings other than as specifically described to practice the invention within the scope of the following claims.

I claim:

1. A braked linear nipper comprising:

a belt roller;

a belt operably coupled to said belt roller;

a belt load operably coupled to said belt for applying a squeeze load along a length of a linear material operably coupled to said belt;

a brake operably coupled to said belt for imparting a tension to said linear material;

a sensor control operably coupled to said linear material and to said brake for controlling said tension to said linear material;

a dispenser operably coupled to said linear material for dispensing said linear material;

a squeeze load platen operably coupled to said belt;

and a layer of compressed gas introduced between said squeeze load platen and said belt.

2. The braked linear nipper of claim 1 further including a heater operably coupled to said squeeze load platen for heating said compressed gas.

3. The braked linear nipper of claim 1 further comprising a traversing frame coupled to said dispenser for winding said linear material around an object.

4. The braked linear nipper of claim 1 wherein said linear material comprises reinforcing fibers embedded in a resin matrix.

5. The braked linear nipper of claim 1 wherein said brake comprises a friction brake.

6. The braked linear nipper of claim 1 wherein said brake comprises an electromagnetic brake.

7. The braked linear nipper of claim 1 wherein said belt load comprises a compression load.

8. The braked linear nipper of claim 1 wherein said belt load comprises a tension load.

9. The braked linear nipper of claim 1 wherein said belt is coupled to said belt roller by positive traction.

10. The braked linear nipper of claim 1 wherein motion is imparted to said belt via said squeeze load by an object from which said linear material is pulled.

11. The braked linear nipper of claim 1 wherein said squeeze load is effected by inducing tension in said belt.

12. The braked linear nipper of claim 3 wherein said traversing frame is mounted on one of a filament winding machine, a linear slide, and a curved track for winding tape around a stationary object.

13. A braked linear nipper comprising:

a belt roller;

a belt coupled to said belt roller;

a belt load coupled to said belt for applying a squeeze load along a length of a linear material coupled to said belt;

a brake coupled to said belt for inducing tension in said linear material;

a sensor control coupled to said linear material and to said brake for controlling said tension in said linear material;

a dispenser coupled to said linear material for dispensing said linear material;

a squeeze load platen coupled to said belt;

and a traversing frame for winding said linear material around stationary objects whereon said belt roller, said belt, said brake, said sensor control, said dispenser, and said squeeze load platen are mounted.

14. The braked linear nipper of claim 13 wherein said traversing frame is mounted on one of a filament winding machine, a linear slide, and a curved track.

15. The braked linear nipper of claim 13 further comprising pins mounted on said belt roller protruding through holes in said belt for providing positive traction between said belt roller and said belt.

* * * * *